United States Patent [19]

Herzer

[11] Patent Number: 4,549,086

[45] Date of Patent: Oct. 22, 1985

[54] OPTICAL-ELECTRONIC MONITORING APPARATUS

[75] Inventor: Gerhard Herzer, Emmendingen, Fed. Rep. of Germany

[73] Assignee: Erwin Sick GmbH Optik-Elektronik, Waldkirch, Fed. Rep. of Germany

[21] Appl. No.: 410,111

[22] Filed: Aug. 20, 1982

[30] Foreign Application Priority Data

Aug. 25, 1981 [DE] Fed. Rep. of Germany ..... 3133494

[51] Int. Cl.[4] ..... G01N 21/86

[52] U.S. Cl. ..... 250/561; 57/81

[58] Field of Search ..... 250/221, 222.1, 560, 250/561, 214 R, 214 RC, 223 B; 356/384, 385, 386, 387; 28/187; 57/81

[56] References Cited

U.S. PATENT DOCUMENTS

| | | | |
|---|---|---|---|
| 3,604,940 | 9/1971 | Matthews | 250/560 |
| 3,900,738 | 8/1975 | McKay | 250/561 |
| 4,267,554 | 5/1981 | Loepfe et al. | 57/81 |
| 4,417,147 | 11/1983 | Faville | 250/560 |

*Primary Examiner*—David C. Nelms

*Attorney, Agent, or Firm*—Townsend and Townsend

[57] ABSTRACT

An optical electronic monitoring apparatus is used to detect undesired coil or lap formation at transport and drive rollers 13. For this purpose the beam 14 of a light barrier is arranged along the surface of the roller 13 parallel to its axis 23 in such a way that it is partially obscured by the cross-section of the roller. The subsequent evaluation circuit has a low pass filter 16, a differentiation stage 17 and a further low pass filter 18.

20 Claims, 4 Drawing Figures

OPTICAL-ELECTRONIC MONITORING APPARATUS

Figure 1:
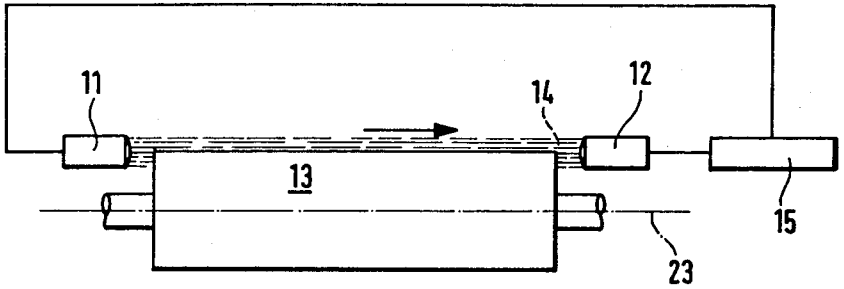

The invention relates to an optical-electronic monitoring apparatus for monitoring for undersired coil or lap formation at transport and drive rollers, the monitoring apparatus comprising a light barrier connected to an evaluation circuit which transmits a warning signal or a stop signal if undesired coil or lap formation occurs.

Monitoring apparatus of this kind is required in the textile industry, in rolling mills and in the manufacture of paper ect. In spinning machines, for example, bobbins onto which the thread emerging from the spinning nozzle is wound are driven by friction with a drive roller. In this arrangement the thread is sometimes wound not in the normal way onto the bobbins but instead onto the drive roller. With the high thread take-off speeds of up to 6000 m/min which are customary nowadays a coil of thread forms almost instantaneously. This coil of thread fuses as a result of fulling work (flexure) and heat generation to form a ball and can cause significant damage to the drive mechanism of the machine. Moreover a considerable amount of time is required to make the plant ready for further operation.

Monitoring apparatus for monitoring for undesired coil or lap formation is already known in which mechanical sensors sensors are arranged in the form of a switching strip along the drive roller or shaft at a small distance from the surface. The coil which forms on the drive roller during a breakdown then scrapes on the switching strip and initiates a signal which first of all jobs the thread via a cutting device and then stops the drive and indicates the disturbance or break.

The disadvantage of this known arrangement lies in the fact that the response time is relative long and also in the fact that the area of the winding apparatus becomes severely contaminated with bits of thread which are created by contact of the coil of thread with the switching strip.

Monitoring apparatus in the form of light sensors which transmit a beam of light radially or perpendicularly to the surface of the drive roller and which recognise a coil of thread in the event of a fault are also known. The output signal of the known light sensor once again causes cutting off of the thread and stopping of the drive. The disadvantage of this known arrangement lies in the fact that the light scanner can only observe a small part of the width of the roller. A multiple arrangement of adjacent light scanners for detecting the whole width of the roller which would also be conceivable, would be very expensive and complex.

The principal object underlying the present invention resides in the provision of an optical electronic monitoring apparatus of the initially named kind by means of which the whole width of the roller can be monitored for undesired coil or lap formation using only a single light barrier.

For this purpose the invention envisages that the light beam from the light barrier is arranged along the surface parallel to the axis of the roller to be monitored in such a way that the light beam cross-section is partly obscured by the cross-section of the roller.

The roller cross-section should in particular obscure 25 to 50% and preferably 30 to 35% of the cross-section of the beam of the light barrier. Any coil formation on the roller, irrespective of where it occurs, thus leads to a reduction of the light flux at the receiver of the light barrier which is processed into a fault signal by the subsequent electronic evaluation circuit.

Although an autocollimation light barrier can in principle also be used it preferable to arrange a light transmitter at one end face of the roller and a light receiver at the opposite end face. A particularly preferred monitoring circuit for the monitoring apparatus of the invention has a low pass filter, a differentiation stage and a further low pass filter. In this manner a series of interference signals are eliminated which could impair the recognition of the undesired coil formation. Such interference signals are caused, for example, by inbalance of the roller, i.e. tolerances in the radius of the roller (distance of the central axis from the surface) which, at the speed of operation, could produce a modulation of the light flux of the same order of magnitude as the measurement signal that is expected.

As a result of the very shallow angle at which the transmitter light source irradiates the surface of the roller, light from the roller is moreover reflected into the surrounding area and can reach the receiver by reflection at surrounding parts. This light component is only insignificantly influenced by the coil and thus represents an environmentally dependent interference threshold. If several neighboring rollers are to be monitored these reflections also give rise to the danger of mutual disturbance.

Moreover, one is interested in rendering stray light from natural or artificial environmental light sources harmless.

In order to form a fault signal a threshold value stage is preferably connected to the second low pass filter. In this arrangement the construction is preferably such that a bistable multivibrator is connected to the threshold value stage and preferably controls a relay.

In order to preclude stray light influences as a result of background light the light barrier is preferably constructed as a pulsed light barrier. In order, with this arrangement, to avoid undesired light flux modulation, for example by a raised bump on the surface of the roller, the frequency of the transmitted pulses should be synchronised and phase locked to the frequency of rotation of the roller.

With this arrangement it is then necessary for a rectifier to be inserted between the receiver amplifier and first low pass filter, with the rectifier delivering a DC voltage proportional to the amplitude of the pulses which is in turn proportional to the light flux.

If several, simultaneously operating, adjacent monitoring units are used then, in accordance with the invention, only one monitoring unit should be activated at any one time, through time multiplex control, in order to avoid mutual interference.

Figure 2:
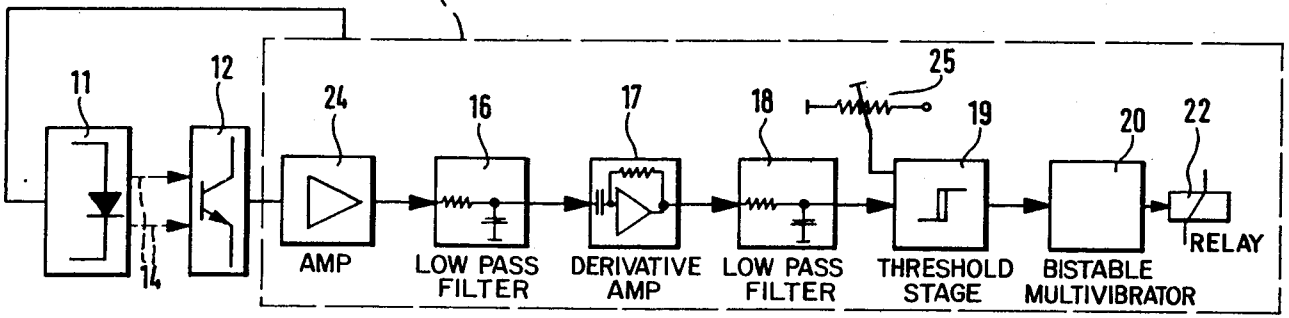
Figure 3:
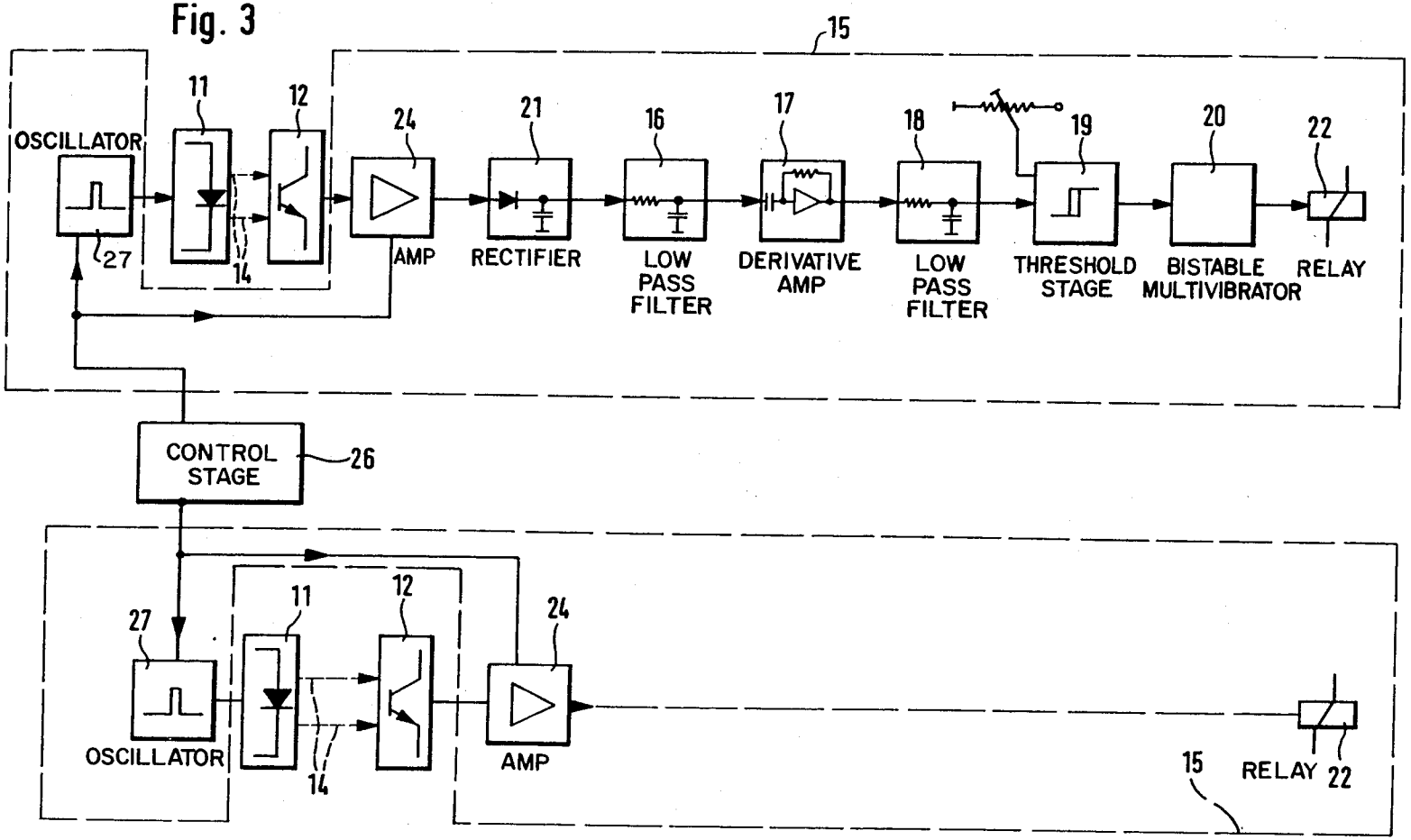

The invention will now be described in the following by way of example only and with reference to the drawings which show:

FIG. 1 a schematic radial view of a roller at which an optical-electronic monitoring apparatus in accordance with the invention is arranged, FIG. 2 a first advantageous embodiment of the evaluation circuit used with this monitoring apparatus, and FIG. 3 a further improved evaluation circuit for the monitoring apparatus of the invention.

Figure 4:
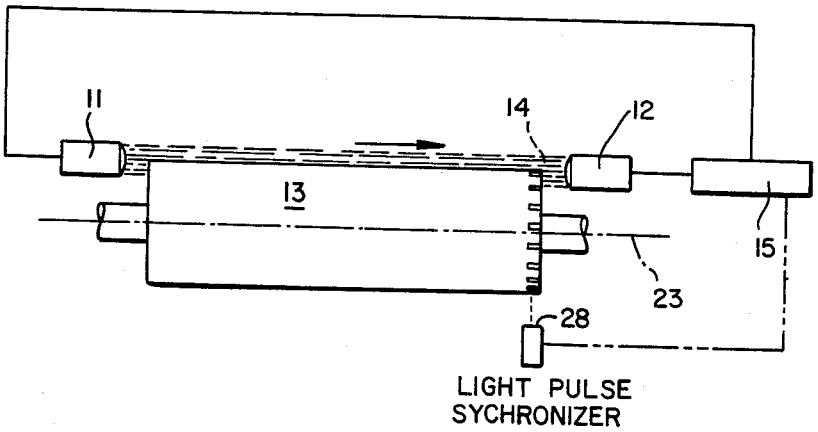

FIG. 4 shows the apparatus of FIG. 1 and a light pulse synchronizer.

As seen in FIG. 1 a light transmitter 11 and a light receiver 12 are arranged at the end faces of a roller 13 rotatable about an axis 23 at axially opposite sides. The light transmitter 11 transmits a light beam 14 to the light receiver 12 which is obscured by approximately one half or rather less by the cross-section of the roller. The light receiver 12 is connected to an electronic evaluation circuit 15 which also delivers the feed current for the light transmitter 11.

The light receiver 12 delivers an electrical output signal proportional to the incident light flux to the electronic evaluation circuit 15, and this output signal is first of all amplified in an amplifier 24 as seen in FIG. 2. The high frequency components which originate from the imbalance of the rotating roller 13 are then filtered out in a subsequent low pass filter 16. This low pass filter 16 is then followed by a differentiation stage 17 which generates an output signal which is proportional to the differential quotient of the change of light flux with time. A subsequent low pass filter 18 forms the mean value of the signal and provides a response delay which precludes the effects of short term light flux changes which are caused by disturbing influences. A threshold value stage 19 connected to the low pass filter 18 compares the output signal of the low pass filter 18 with a predetermined switching threshold selectable by means of a potentiometer 25 which, if exceeded, results in a fault signal at the output which sets a bistable multivibrator 20. The output signal of the bistable multivibrator 20 can now be used to energise a relay 22, or an electronic switching state, which switches off the machine and/or actuates the thread cutting apparatus and/or initiates an indication of a fault.

In order to exclude stray light effects due to environmental light sources the light transmitter 11 of the embodiment of FIG. 3 is controlled so that it delivers a pulsed light beam 14. For this purpose an oscillator 27 with a pulse shaper delivers an AC voltage so that the light transmitter connected to the oscillator 27 transmits a corresponding pulsed light beam. The receiver amplifier 24 is correspondingly constructed as an AC voltage amplifier, and indeed with a bandwidth which transmits the useful signal from the transmitter but blocks disturbing signals from stray light sources.

The oscillator 27 is also connected to the amplifier 24 in order to form a start signal so that the receiver 24 is only in operation when a light pulse is transmitted by the light transmitter 11.

In other respects the function and the construction of the pulse light barrier is regarded as known. However, the problem occurs that the influence of the imbalance cannot simply be eliminated by a low pass filter.

If one namely assumes that the roller 13 has a raised bump at the surface this bump will produce a change of the light flux at the receiver 12 with a frequency which is determined by the difference of the frequency of the transmitted pulse and the frequency of rotation (speed of the roller 13). This light flux modulation can fall in the transmission range of the low pass filter 16 and thus make it difficult or indeed impossible to clearly distinguish the measured signal. In order to avoid this effect the pulse frequency of the transmitter is synchronised and phase locked to the frequency of rotation of the roller 13. While it is in principle sufficient, with rollers 13 with a smooth surface, to transmit one light pulse per revolution the speed of response increases if several transmitted light pulses occur per revolution of the roller. There are also special rollers with inclined (helical) grooves at the surface. With these the coil of thread lies partly in the groove and partly on the surface of the roller so that in this case an increasing number of transmitted pulses are necessary per revolution of the roller so that the coil formation can be recognised.

With this arrangement a rectifier 21 is inserted between amplifier 24 and first low pass filter 16. Rectifier 21 delivers DC voltage proportional to the amplitude of the pulser which is in turn proportional to the light flux. FIG. 4 shows the use of a light pulse synchronizer 28 which uses an additional light sensor, possibly also an inductive sensor, which scans several reflex marks 30 which are uniformly distributed over the periphery of roller 13, and which stimulates a transmitted pulse of the monitoring light barrier with each scanning pulse of the reflex light barrier.

Moreover a phase locked loop circuit (PLL circuit) can be used for frequency multiplication. The PLL circuit receives pulses with the speed of rotation of the roller 13 and delivers an output frequency for the transmitter of the monitoring light barrier which is multiplied by a whole number and phase locked with the input frequency. Again a light barrier, an inductive sensor or, if the roller is driven with a synchronous motor, the direct sinusoidal supply voltage for the roller motor can be used as a sensor for detecting the frequency of rotation of the roller.

If several such monitoring units are simultaneously in operation at a roller, which may possibly be divided (for example with very large roller widths above ca. 5 m), or at several adjacent rollers, the danger exists of mutual disturbance through reflection of the transmitted light at the surroundings. A time multiplex control stage 26 (FIG. 3) which ensures that only one of the monitoring units is activated at any one time helps to counteract this danger in known manner. I.e. the individual monitoring units are switched in and out in a rapid sequence one after the other. In the embodiment of FIG. 3 two monitoring units are connected, by way of example, to the control stage 26 with the lower one being identically constructed to the upper one. However, not all the stages of the upper unit are shown in detail for the lower unit but are merely indicated by a broken line.

The dimensioning of the analog function blocks is determined by the mechanical details, above all by the dynamic parameters. The dimensioning can be matched within broad limits to the requirements. In addition to purely analog signal processing, which has been described above, it is also possible, after digitising the analog signal delivered by the amplifier, to design individual or all subsequent function blocks in digital form (microprocessor) and indeed particularly when the frequency range of the signals to be evaluated lies in the range below 0.1 Hz.

Finally attention should be drawn to the fact that in the simplest case a scan is carried out once at the same point on the periphery of the roller for each revolution of the roller 13. For this the transmitter can send either one pulse or a whole series of pulses. It is also possible for the transmitter to transmit permanently and for the receiver to be activated by the oscillator 27 in such a way that it evaluates the received signal either only at one point or at several points of the rotational movement. The start signal which starts the transmitter or the receiver can also be obtained from a proximity initiator, or from the machine control, instead of through a light barrier.

I claim:

1. Apparatus for monitoring undesired material buildup along the surface of a rotating object, the object having first and second ends through which an axis of rotation passes, the apparatus comprising:

a radiant energy transmitter positioned at the first end of the object to direct a beam of radiant energy parallel to the object surface with a portion of the radiant energy beam being obscured by the object;

a radiant energy receiver at the second end of the object positioned to receive at least a portion of the radiant energy beam; and an electrical evaluation circuit means, coupled to the radiant energy receiver, for providing an indication of material buildup along the object surface, the circuit means including in series a first low pass filter following the radiant energy receiver, a derivative stage for producing a first signal according to the change in radiant energy, received by the radiant energy receiver, with respect to time, and a second low pass filter for producing a second signal.

2. The apparatus of claim 1 wherein the object obscures between about 20% to 50% of the beam.

3. The apparatus of claim 2 wherein the object obscures between about 30% to 35% of the beam.

4. The apparatus of claim 1 wherein the radiant energy receiver is positioned adjacent the object second end.

5. The apparatus of claim 1 wherein the radiant energy beam is parallel to the axis of rotation.

6. The apparatus of claim 1 wherein the circuit means further includes a threshold value stage following the second low pass filter for producing a third signal when the second signal from the second low pass filter exceeds a chosen value.

7. The apparatus of claim 6 wherein the circuit means further includes a bistable multivibrator following the threshold valve stage and a relay following the bistable multivibrator.

8. The apparatus of claim 1 wherein the radiant energy beam is a light beam.

9. The apparatus of claim 1 wherein the radiant energy transmitter transmits a pulsed radiant energy beam so to reduce the influence of stray radiant energy.

10. The apparatus of claim 9 further comprising means for synchronizing the pulsed radiant energy beam transmission according to the rotation of the rotating object.

11. The apparatus of claim 9 further comprising means for controlling the timing of the transmission of the pulsed radiant energy beam so to eliminate mutual interference between a plurality of monitoring apparatus in the same vicinity.

12. Apparatus for monitoring undesired material buildup along the surface of a rotating cylindrical roller, the roller having first and second ends through which the axis of rotation passes, the apparatus comprising:

a radiant energy transmitter positioned opposite the first end of the roller to direct a beam of pulsed radiant energy parallel to the axis of rotation with a portion of the pulsed radiant energy beam being obscured by the roller;

a radiant energy receiver opposite the second end of the object positioned to receive at least a portion of the pulsed radiant energy beam;

means for synchronizing the pulsed radiant energy beam transmission according to the rotation of the rotating object; and an electrical evaluation circuit means, coupled to the radiant energy receiver, for providing an indication of material buildup along the object surface, the evaluation circuit means including in series a first low pass filter following the radiant energy receiver, a derivative stage for producing a first signal according to the change in radiant energy, received by the radiant energy receiver, with respect to time, and a second low pass filter for producing a second signal.

13. Apparatus for monitoring for undesired coil or lap formation at a roller, the roller having an axis, the monitoring apparatus comprising:

a light barrier, including a light transmitter and a light receiver, the light transmitter producing a light beam directed along the roller surface parallel to the roller axis, the light beam cross-section being partly obscured by the cross-section of the roller;

an evaluation circuit, connected to the light barrier, which transmits a signal if undesired coil or lap formation occurs; and the evaluation circuit including in series a first low pass filter following the radiant energy receiver, a derivative stage for producing a first signal according to the change in radiant energy, received by the radiant energy receiver, with respect to time, a second low pass filter for producing a second signal, and a threshold stage for transmitting a third signal when the second signal exceeds a pre-selectable threshold.

14. Apparatus in accordance with claim 13 wherein the roller obscures from 20% to 50% of the cross-section of the light beam.

15. Apparatus in accordance with claim 13 wherein the roller obscures from 30% to 35% of the cross-section of the light beam.

16. Apparatus in accordance with claim 13 wherein the light transmitter is arranged adjacent one end of the roller and the light receiver adjacent the opposite end.

17. Apparatus in accordance with claim 13 wherein a bistable multivibrator is connected to and follows the threshold stage.

18. Apparatus in accordance with claim 13 further comprising a relay controlled by the bistable multivibrator.

19. Apparatus in accordance with claim 13 wherein the light barrier is constructed as a pulsed light barrier, and wherein the evaluation circuit includes a receiver amplifier following the light receiver and a rectifier connected between the receiver amplifier and the first low pass filter, with the rectifier delivering a DC voltage proportional to the pulse amplitude, which is in turn proportional to the light flux.

20. Apparatus in accordance with claim 19 further comprising means for synchronizing the frequency of the pulsed light barrier with the rotation of the roller.

* * * * *